US005210550A

United States Patent [19]

Fisher et al.

[11] Patent Number: 5,210,550

[45] Date of Patent: May 11, 1993

[54] MAINTENANCE STATION FOR INK JET PRINTERS

[75] Inventors: Almon P. Fisher, Rochester; Herman A. Hermanson, Penfield, both of N.Y.

[73] Assignee: Xerox Corporation, Stamford, Conn.

[21] Appl. No.: 812,088

[22] Filed: Dec. 23, 1991

[51] Int. Cl.[5] ..... B41J 2/165

[52] U.S. Cl. ..... 346/140 R

[58] Field of Search ..... 346/140 R, 75

[56] References Cited

U.S. PATENT DOCUMENTS

| | | | |
|---|---|---|---|
| 4,223,324 | 9/1980 | Yamamori et al. | 346/140 R |
| 4,432,004 | 2/1984 | Glattli | 346/140 R |
| 4,577,203 | 3/1986 | Kawamura | 346/140 R |
| 4,638,337 | 1/1987 | Torpey et al. | 346/140 R |
| 4,679,059 | 7/1987 | Dagna | 346/140 R |
| 4,746,938 | 5/1988 | Yamamori et al. | 346/140 R |
| 4,849,774 | 7/1989 | Endo et al. | 346/140 R |
| 4,853,717 | 8/1989 | Harmon et al. | 346/140 R |
| 4,855,764 | 8/1989 | Humbs et al. | 346/140 R |
| 5,005,024 | 4/1991 | Takahashi et al. | 346/1.1 |
| 5,097,276 | 3/1992 | Midorikawa | 346/140 R |

FOREIGN PATENT DOCUMENTS

| | | |
|---|---|---|
| 2519160 | 9/1976 | Fed. Rep. of Germany . |
| 3612299 | 4/1985 | Fed. Rep. of Germany . |
| 53-79536 | 2/1978 | Japan . |
| 54-119238 | 9/1979 | Japan . |
| 62-271749 | 11/1987 | Japan . |

*Primary Examiner*—Benjamin R. Fuller
*Assistant Examiner*—N. Le
*Attorney, Agent, or Firm*—Robert A. Chittum

[57] ABSTRACT

A maintenance station for an ink jet printer of the type having a printhead movable between an operating position and a maintenance position provides the capability of priming the printhead as well as maintaining a humid environment to prevent ink from drying out in the printhead orifices. The maintenance station is located adjacent the printhead maintenance position periodically occupied by the printhead and is positionable towards and away from the printhead. The maintenance station comprises a movable chamber having a rigid wall confronting the printhead and the chamber wall has an aperture. A seal means comprises a resilient floating bed base with a opening similar in size to the chamber wall aperture and resilient lips extending from the periphery of the base opening, the outer edge of which is larger than the base opening, so that the lips of the seal means have a predetermined slope. This seal means enable fluid-tight sealing between the chamber and the printhead, even if they are not in alignment with each other.

8 Claims, 3 Drawing Sheets

MAINTENANCE STATION FOR INK JET PRINTERS

BACKGROUND OF THE INVENTION

The present invention relates to maintenance stations for ink jet printing apparatus and is concerned, more particularly, with the sealing of the maintenance station with a printhead in such apparatus, especially when the maintenance station and printhead are not in alignment with each other; i.e.; misaligned in X, Y, or Z directions.

An ink jet printer of the so-called "drop-on-demand" type has at least one printhead from which droplets of ink are directed towards a recording medium. Within the printhead, the ink may be contained in a plurality of channels and energy pulses are used to cause the droplets of ink to be expelled, as required, from orifices at the ends of the channels.

In a thermal ink jet printer, the energy pulses are usually produced by resistors, each located in a respective one of the channels, which are individually addressable by current pulses to heat and vaporize ink in the channels. As voltage is applied across a selected resistor, a vapor bubble grows in that particular channel and ink bulges from the channel orifice. At that stage, the bubble begins to collapse. The ink within the channel retracts and separates from the bulging ink which forms a droplet moving in a direction away from the channel orifice and towards the recording medium. The channel is then re-filled by capillary action, which in turn draws ink from a supply container. Operation of a thermal ink jet printer is described in, for example, U.S. Pat. No. 4,849,774.

One particular form of thermal ink jet printer is described in U.S. Pat. No. 4,638,337. That printer is of the carriage type and has a plurality of printheads, each with its own ink supply cartridge, mounted on a reciprocating carriage. The channel orifices in each printhead are aligned perpendicular to the line of movement of the carriage and a swath of information is printed on the stationary recording medium as the carriage is moved in one direction. The recording medium is then stepped, perpendicular to the line of carriage movement, by a distance equal to the width of the printed swath and the carriage is then moved in the reverse direction to print another swath of information.

It has been recognized that there is a need to maintain the ink ejecting orifices of an ink jet printer, for example, by periodically cleaning the orifices when the printer is in use, and/or by capping the printhead when the printer is out of use or is idle for extended periods. The capping of the printhead is intended to prevent the ink in the printhead from drying out. There is also a need to prime a printhead before use, to ensure that the printhead channels are completely filled with ink and contain no contaminants or air bubbles. Maintenance and/or priming stations for the printheads of various types of ink jet printer are described in, for example, U.S. Pat. Nos. 4,855,764; 4,853,717 and 4,746,938 while the removal of gas from the ink reservoir of a printhead during printing is described in U.S. Pat. No. 4,679,059.

It has been found that the printing operation or the priming operation, which usually involves either forcing or drawing ink through the printhead, can leave drops of ink on the face of the printhead and that, ultimately, there is a build-up of ink residue on the printhead face. That residue can have a deleterious effect on print quality. It has also been found that paper fibers and other foreign material can collect on the printhead face while printing is in progress, and like the ink residue, can also have a deleterious effect on print quality. It has previously been proposed, in U.S. Pat. No. 4,853,717, that a printhead should be moved across a wiper blade at the end of a printing operation so that paper dust and other contaminants are scraped off the orifice plate before the printhead is capped. It has also been proposed, in U.S. Pat. No. 4,746,938, that an ink jet printer should be provided with a washing unit which, at the end of a printing operation, directs water at the face of the printhead to clean the latter before it is capped.

U.S. Pat. No. 4,223,324 to Yamamori et al. discloses a system comprising a writing head consisting of a liquid chamber supplied liquid, a liquid discharge channel through which the liquid is discharged from the liquid chamber, and an air discharge channel through which dry air is ejected simultaneously with the liquid to a writing surface. A humidifier is provided which is operative when a writing head is in a standby position. A closing member is mounted with respect to the air discharge channel to close it when the writing head is in the standby position. The member acts to direct the humidified air through the exit side of the liquid discharge channel to an air outlet channel. The system is provided with a heating arrangement for heating the humidified air to prevent it from condensing in an air passage leading from the humidifier to the writing head when ambient temperature is low.

German Publication No. 3612299 discloses an ink jet printer comprising a protective cap which can be placed over a printing head when the latter is not in use. A protective solution can be introduced to the protective cap to prevent blockages. A tank, partially filled with a water absorbing polymer material is provided for receiving dirty protective solution when it returns from the cap device.

Japanese Publication No. 53-79536 discloses an apparatus comprising a double sealing arrangement consisting of a nozzle surrounded by a small elastic ring and a large elastic ring. A sponge impregnated with liquid is housed in a space between the small and large rings. The housing prevents ink in the ink jet nozzle from evaporating, thereby preventing clogging of the nozzle.

Japanese Publication No. 62-271749 discloses a provision comprising a cavity wall of a sealing means with a recessed part capable of holding a recording liquid. Under a capped condition, the provision prevents ink coagulation at an ink ejecting port.

Japanese Publication No. 54-119238 discloses a device comprising a clogging preventive device. The device consists of a wetting solution tank and a lip packing holder which is secured to the tank. A lip packing, consisting of rubber, is fitted to a free end of the holder, and one end of a sponge body is inserted into a designated hole in the holder. Another end of the sponge is dipped into the wetting solution in the tank. When not printing, a gap between a head and the holder can be hermetically enclosed.

German Publication No. 2519160 discloses an ink jet printer comprised of ink jet nozzles. The nozzles are covered by a liquid-soaked movable pad. The pad is deformable by engagement with a printing head. Furthermore, the pad is connected to a reservoir which is filled with a water repellent.

One problem encountered with prior art maintenance and/or priming stations is that fluid-tight sealing between the stations and the printhead faces containing the droplet ejecting orifices is not accomplished unless the station walls supporting the resilient gaskets are substantially parallel and aligned with the printhead faces. Such an arrangement requires costly high tolerance assemblies and components. The maintenance station of the present invention avoids the need for such high tolerance alignment between the maintenance station and the orifice containing printhead face.

SUMMARY OF THE INVENTION

It is an object of the present invention to provide a maintenance station capable of effective sealing against the nozzle face of a printhead for an ink jet printer, when the printhead is in the maintenance position, even when there is some misalignment between them.

According to the present invention, a movable printhead assembly for a thermal ink jet printer comprises a printhead having an array of ink channels therein, an ink ejecting orifice at one end of each channel for directing droplets of ink expelled from the channel towards a recording medium, and a printhead face containing the ink ejecting orifices; the printhead assembly is movable between a printing operation position and a maintenance position; and when the printhead assembly is in the maintenance position, a maintenance station is movable into a sealing relationship with the printhead face to cap and seal the orifices.

In a thermal ink jet printer in accordance with the invention, a heating element is provided to heat ink in each of the printhead channels to cause ink droplets to be expelled from the ink ejecting orifices. The maintenance station may comprise a movable chamber having an internal partition, dividing the chamber into upper and lower partions, and having a relatively rigid wall confronting the face of the printhead. The wall has at least one elongated aperture therein to provide access to the chamber upper portion. A seal having a resilient base is secured to the chamber wall in a fluid-tight manner. The seal base has an opening of similar size and shape as the chamber wall aperture and has lips which extend upwardly from around the base opening. The chamber is movable towards and away from the printhead. In a first position of the chamber, the seal lips engages the printhead face and surroundingly caps the printhead orifices. In a second position of the chamber, the seal lips are directed towards, but are spaced apart from the printhead face. Means is provided to apply a suction to the chamber upper portion, when the chamber is in the first position to apply suction to the printhead orifices and to remove any ink from the chamber upper portion. In one embodiment of the invention, a chamber lower portion containing a fluid, such as water, if water based inks are used, and a wick means extending therefrom into the chamber upper portion for maintaining a humid environment in the chamber upper portion. In another embodiment, the seal base is secured to the chamber wall at its border which is thicker than the rest of the seal base, so that the seal base may function as a diaphragm thereby adding additional sealing capability for the chamber seal when the printhead and maintenance station chamber are not aligned. Even more sealing flexibility is obtained when the lips have an outer edge which define an opening larger than the base opening, so that a skirt is formed between the lip edges and the seal base having a slope at a predetermined angle.

BRIEF DESCRIPTION OF THE DRAWINGS

By way of example, an embodiment of the invention will be described with reference to the accompanying drawings wherein like numeral designate like parts, in which.

DESCRIPTION OF THE PREFERRED EMBODIMENT

Figure 1:
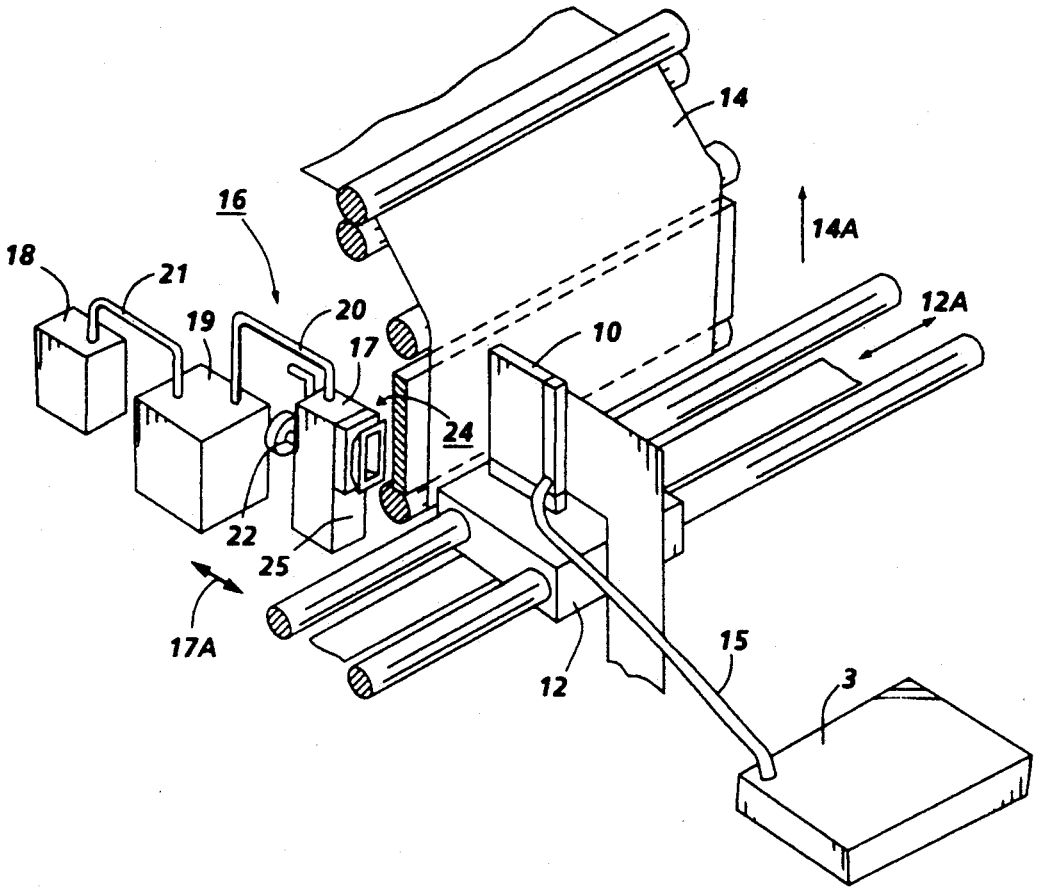
FIG. 1 is a schematic drawing of a partially shown thermal ink jet printer containing the maintenance station of the present invention.

The printer shown in FIG. 1 has a printhead 10 mounted on a carriage 12 and connected to receive ink from a supply container 13 through flexible hose 15. The printhead 10 contains a plurality of ink channels (not shown in FIG. 1) which carry ink from the supply container 13 to respective ink ejecting orifices (also not shown in FIG. 1). In use, the carriage 12 reciprocates as indicated by the arrow 12A and droplets of ink are expelled from selected ones of the printhead orifices (in the manner already described) and are directed towards a recording medium 14, for example a paper sheet. During each pass of the carriage 12, the recording medium 14 is stationary, but at the end of each pass, it is stepped in the direction of the arrow 14A. For a more detailed explanation of the printhead and printing thereby refer to U.S. Pat. No. 4,571,599 and U.S. Pat. No. Re. 32,572 incorporated herein by reference.

At one side of the printer, outside the printing zone which encompasses the width of the recording medium, is a maintenance station 16. At the end of a printing operation, the printhead carriage 12 is parked in a maintenance position confronting this maintenance station 16, which comprises a chamber 17 and an associated suction pump 18 in communication with each other through a waste tank 19 and lines 20, 21 interconnecting the interior of the chamber with the waste tank and the waste tank and pump, respectively. The chamber 17 is movable towards and away from the printhead 10, as indicated by the arrow 17A, by for example, a solenoid 22, and has a seal means 24 secured to a rigid wall 25 of the chamber.

Figure 2:
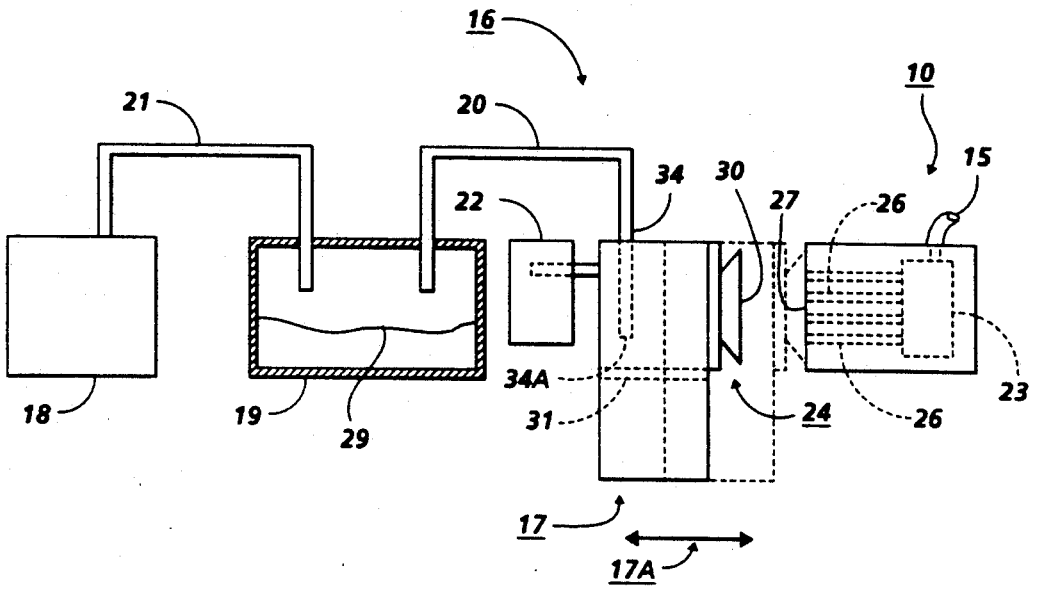
FIG. 2 is a diagrammatic side view showing the printhead and the maintenance station of a thermal ink jet printer.

Referring to FIG. 2, a schematic diagram of a side view of the maintenance station 16 of the present invention is shown. The maintenance station not only performs the function of providing a humid environment for the printhead orifices or nozzles, but also performs the function of priming the printhead. As is well known in the printer industry, the priming operation draws ink from an ink supply and fills the printhead channels 26 (shown in dashed line). Hose 15 connects the ink supply to the printhead orifices 28 (FIG. 3) in printhead face 27. While drawing the ink into the printhead channels, it also clears out air trapped in the ink feed line (flexible hose 15), printhead reservoir 23 (shown in dashed line), and channels 26. In the preferred embodiment, a low cost, low volume vacuum or suction pump 18 capable of drawing a partial vacuum 65 to 140 water is used. A waste tank 19 collects waste ink 29 during priming of the printhead 10. The ability to use a low volume vacuum pump is obtained when an excellent seal is achieved at the printhead face 27. With the fluid tight seal achieved by seal means 24, the vacuum suction rises in about one second to a point where the ink channels are well primed. When the maintenance station is pulled away from the printhead, in-rushing air over the printhead and seal means 24 clears out any ink on the printhead face 27. Because the prior art maintenance stations are generally not perfectly aligned with the printhead faces, fluid-tight seals are not achieved, thereby requiring large expensive and often noisy suction pumps to obtain the same priming results as that of the present invention. The lack of a good seal also results in incomplete priming of the printhead.

The seal means 24 performs two important tasks to enable a good seal to occur. The first is that it surrounds the linear array of orifices or nozzles 28 in the printhead face and conforms to irregular surfaces. The second is that it compensates for relative cock and misalignment between the printhead face and the plane of seal surface or lips 30 which comes into contact with the printhead face and makes the fluid-tight seal. In the arrangement of a maintenance station shown in FIG. 2, the chamber and seal means are shown moved into in fluid-tight chamber sealing relationship with the printhead face in dashed line from a spaced location confronting the printhead shown in solid line. The larger the array of orifices to be sealed, the more the pressure may have to be increased that is applied to the seal means of prior art maintenance stations to obtain a satisfactory seal, if the prior art station walls and printhead faces are slightly misaligned. Also, ink removal from in-rushing air around prior art seals will be less effective with some seal misalignment because the air will tend to enter from one area of such seal. Therefore, the more gentle, resilient or flexible seal design of the present invention is used to overcome these sealing difficulties as discussed in more detail later.

Although the printhead face is shown standing vertical in FIG. 2, the seal means is equally usable in a horizontal orientation for a printhead pointing down or up. When the printhead is moved from an operating position confronting the recording medium to a maintenance position on one side of the recording medium, where it confronts the movable maintenance station chamber 17, a means for moving the chamber from a location spaced from the printhead in a direction towards the printhead causes the seal means 24 to come into a fluid-tight sealing relationship with the printhead face. When it is desired to move the printhead from the maintenance position for resumption of printing, the means for moving the chamber, from the sealed relationship with the printhead face, withdraws the chamber and returns it to a location spaced from the printhead. In the preferred embodiment, the means for moving the chamber is a solenoid 22 which causes the chamber to be selectively moved towards and from the printhead, as indicated by arrow 17A, when the printhead is parked in the maintenance position.

Figure 3:
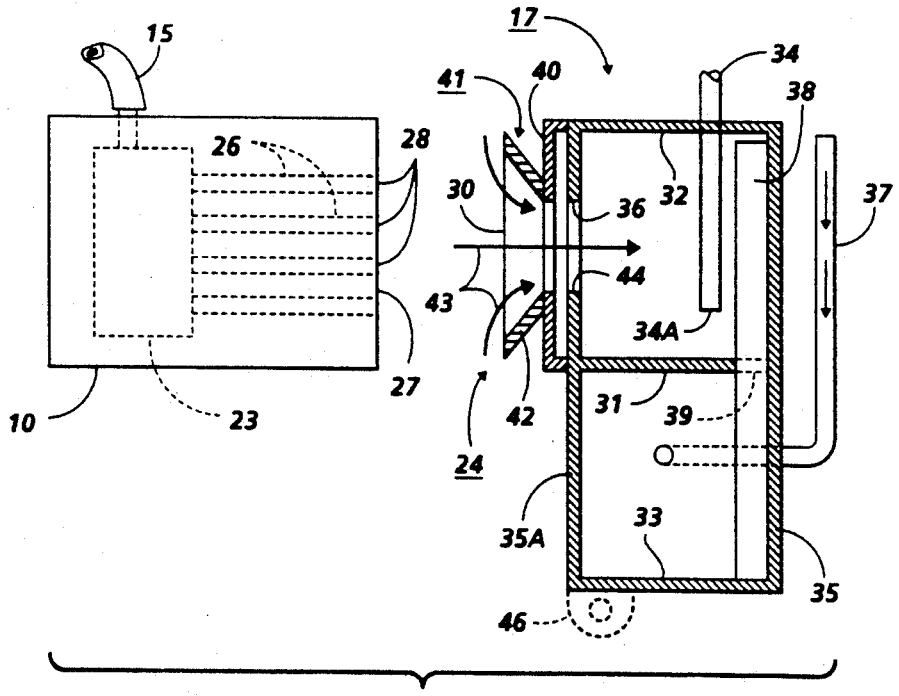
FIG. 3 is an enlarged cross-sectional view of the maintenance station of FIG. 1.

As discussed in more detail with respect to FIG. 3, the chamber 17 is divided into an upper portion 32 and a lower portion 33 by partition 31. A conduit or pipe 34 penetrates the chamber upper portion and one end extends to a location near the partition, which acts as a floor for the chamber upper portion. The other end of the conduit 34 is connected to line 20 which terminates in waste tank 19. Line 21 connects the waste tank to the suction pump 18, so that a suction produced by the suction pump removes ink accumulated in the chamber upper portion and deposits it in the waste tank as waste ink 29. Thus, as soon as the ink in the chamber upper portion rises to the end 34A of the conduit, the suction pump removes it to the waste tank.

As indicated above, the maintenance station also provides a humid environment for the printhead orifices. This humid environment is important for maintaining printhead readiness to print and a useful lifetime. Low humidity, while the printhead is parked at the maintenance position during non-printing times, can result in the ink in the printhead orifices becoming too viscous or too dried to be ejected by the printhead and, therefore, requiring that the various or dried ink be removed by an expensive cleaning procedure or printhead replacement. The task of maintaining humidity becomes very easy if the environment is contained in the presence of, for example, water for water based inks. However, small leaks in the maintenance station seals will lower the humidity significantly, so that a good fluid-tight seal is important. Such fluid-tight seals in printheads having a large number of orifices such as a linear array of 192 orifices, is difficult to seal unless high tolerance printhead carriage, carriage drive mechanisms, and maintenance stations are provided which are very costly.

The maintenance station chamber 17, shown in FIG. 3, consists of a housing 35 having an upper portion 32 and a lower portion 33 produced by partition 31. The housing is enclosed by rigid walls, the wall 35A confronting the printhead maintenance position has an elongated aperture 36, sized to receive droplets from all of the printhead orifices, so that orifice clearing droplets may be fired into the chamber upper portion, if desired. Should priming of the printhead be necessary as explained before, a suction placed on the conduit 34 sucks ink from the printhead orifices, through the aperture 36, and into the chamber upper portion. When the ink reaches a height sufficient to place conduit end 34A in contact with the ink accumulated in the upper portion, the suction removes the ink and deposits it into the waste tank. A wicking material 38 such as a sponge, is inserted in a passage hole 39 in the partition 31, and a fluid, such as water for water-based inks, is filled in the chamber lower portion 33 through fill line 37. The fluid in the lower portion is maintained by refilling as required. The wicking material wicks the fluid from the chamber lower portion into the chamber upper portion where the fluid evaporates to maintain the humid environment in the chamber upper portion. The surface area of the wicking material or sponge is large enough to enable the appropriate amount of evaporation to take place.

Figure 5:
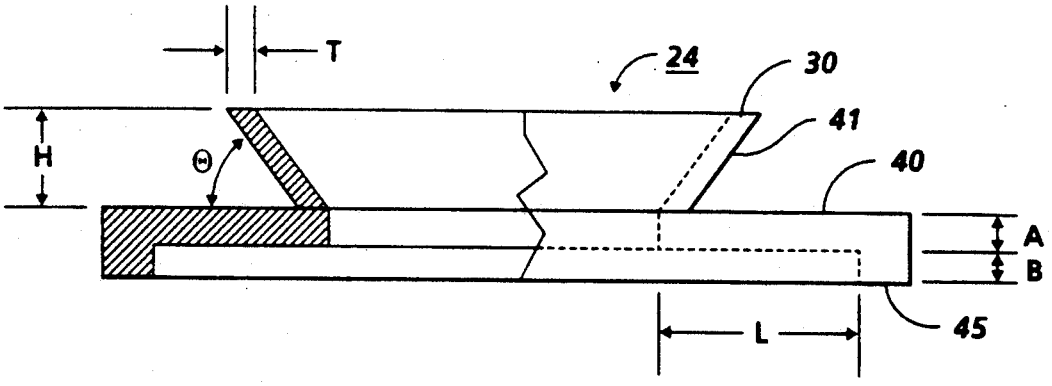
FIG. 5 is a partially sectioned, side view of the seal in FIG. 4.

A resilient seal means 24 has a floating bed base 40 with an opening 44 having a size substantially equal to the chamber aperture 36. The base 40 is sufficiently larger than the chamber wall aperture 36 to provide some freedom of movement relative to lips 41 which extend outwardly from the periphery of the base opening 44. The base opening is aligned with the chamber wall aperture. The outer edge 30 of the lips has a larger perimeter than the base opening so that a skirt 42 is formed between the outer edge of the lips and the base 40 having a predetermined angle $\theta$ (FIG. 5). This seal means design performs two important tasks to enable a good fluid-tight seal to occur. The first is that it encompasses the array of orifices in the printhead face and conforms to irregular surfaces. The second is that it compensates for cock and misalignment of the printhead face 27 relative to the chamber wall 35A. Because these two functions are separated in the seal means design, a seal means having superior sealing characteristics is provided. When the chamber 17 is withdrawn from the printhead 10, the suction pump is still energized, so that air is sucked in from around the outer edge 30 of the seal lips 41 just at the moment the seal is broken to remove any ink from the vicinity of the printhead orifices as indicated by arrows 43.

Figure 4:
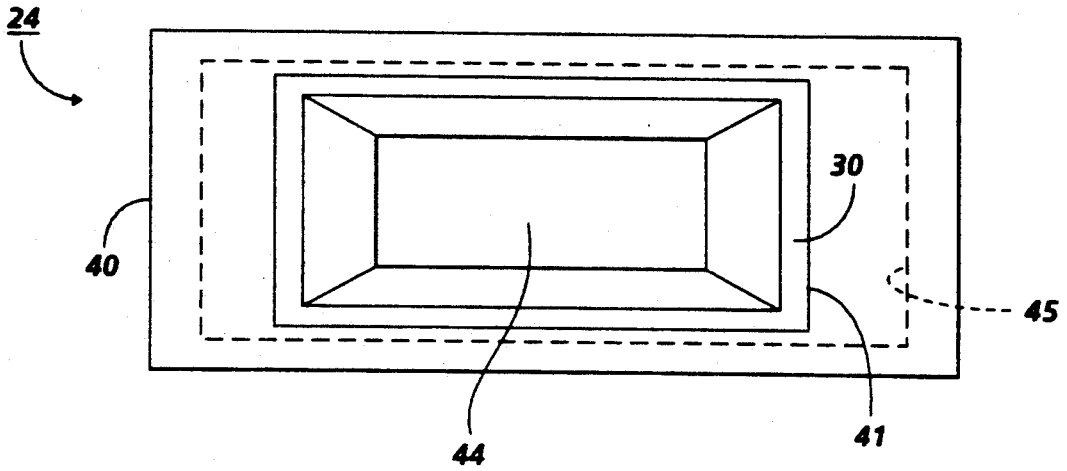
FIG. 4 is a plan view of the maintenance station seal.

Referring to FIG. 4 and FIG. 5, a top view and a partially sectioned side view of the seal means 24 is respectively shown. The sealing by the seal means is achieved by a beveled lip design, wherein the outer edge 30 of the lips 41 are larger than the opening 44 in the floating bed base 40, thereby forming skirt 42 having angle $\theta$ with the base. The sealing of the seal means to the printhead face is achieved by the beveled lip or sloped skirt 42. Conformity of the lip outer edge 30 is dependent on the material of construction, the thickness "T" of the lip, height "H" of the skirt, and bevel or slope angle $\theta$ of the skirt. The outer edge of the seal lips seals by spreading outwardly when it makes contact with the printhead face. Because the lips of this seal means cannot alone compensate for large angles of cock and misalignment between the chamber wall 35A and, thus, the outer edge of the lips, the floating bed base design allows the seal lips or seal skirt to be shifted or slightly twisted and/or turned and yet be moved as a unit. This extra amount of freedom of movement obtained by the floating bed base is determined by the material of construction, the thickness "A" of the bed, its length "L" and the height of the stand-off "B" at its borders. The seal means is adhered to the chamber wall 35A at its border 45. Though any open or closed foam synthetic material may suffice to be molded into the seal means, the material which sheds the fewer particles is preferred, such as a silicone polymeric material, a commercial example of which is RTV 31® by General Electric Company.

For a typical printhead face having about 192 linearly arranged orifices on a 300 spots per inch (spi) spacing, with the orifices having an area of about 700 mils sq., an example of a sufficient seal means would have a lip thickness T of about 10 mils, a skirt height H of about 80–100 mils and a bevel angle $\theta$ of between 30° and 45°. The floating bed base thickness A is about 50–75 mils and the stand off thickness B of the base is about 50–100 mils.

Though the preferred embodiment uses straight line motion for the maintenance station chamber 17, it could use an arcuate motion by pivoting the chamber about flanges 46, shown in dashed line in FIG. 3, and using the solenoid 22 as the pivoting force. Prior art seals for such relatively large printhead faces would not provide an adequate seal, but the design of the present invention provides this flexibility.

The procedure for maintaining a printhead as described above can be used with other forms of drop-on-demand printers, including printers having a plurality of printheads and printers in which, instead of a remote ink supply, each printhead has its own ink cartridge which is also mounted on the carriage 12. A similar maintenance and priming procedure could also be used in printers in which the printheads are not mounted on a reciprocable carriage but remain stationary; e.g. so-called 'pagewidth' printers. Moreover, the maintenance procedure could be utilized outside the field of ink jet printing, being applicable to other situations involving the periodic cleaning of fluid discharge orifice/nozzles.

Many modifications and variations are apparent from the foregoing description of the invention, and all such modifications and variations are intended to be within the scope of the present invention.

We claim:

1. Maintenance station for use in a thermal ink jet printer having a printhead movable between an operating position and a maintenance position, the printhead having a substantially planar face with a linear array of orifices therein through which ink is selectively ejected, the maintenance station being located adjacent to the maintenance position periodically occupied by the printhead and being positionable towards and away from the printhead face, the maintenance station comprising:

a chamber having an interior and a relatively rigid wall confronting the face of the printhead, the chamber wall having at least one aperture therein to provide an inlet to said chamber interior;

a resilient seal means having a resilient base with borders therearound secured to the chamber wall in a fluid-tight manner and with an opening therein substantially aligned with the chamber wall aperture and having resilient lips surrounding and extending from the base opening, said lips being adapted to come into sealing engagement with the face of the printhead when the printhead is in the maintenance position and the chamber is moved from a position spaced from the printhead toward and into contact with the printhead face, whereby the interior of the chamber is placed in fluid-tight communication with the array of printhead orifices, even when there is some misalignment between the printhead face and the chamber;

means for reducing the pressure in the chamber interior selectively to below atmospheric when the seal means is in sealing engagement with the printhead face, so that ink may be sucked from within the printhead through the ejection orifices and into the chamber in order to remove air from the printhead and thereby prime said printhead;

means for maintaining a humid environment in the chamber interior to prevent the ink in said array of orifices from drying out when the seal means lips are in fluid-tight engagement with the printhead face and surrounding the orifices; and means for moving the chamber from a position spaced from the printhead towards the printhead, when the printhead is in the maintenance position, so that the seal lips come into fluid-tight engagement with the printhead face and surround the array of orifices without the need for the chamber wall being parallel to the printhead face or in close alignment therewith.

2. A maintenance station as claimed in claim 1, wherein the seal means base is a floating base having only the base borders secured to the wall of the chamber, so that an extra amount of freedom of movement is obtained.

3. A maintenance station as claimed in claim 2, wherein the borders of the seal base is thicker than the rest of the seal base.

4. A maintenance station as claimed in claim 3, wherein the chamber further comprises:

an internal partition which divides the chamber interior into upper and lower portions, the chamber wall aperture being located to provide said inlet into the chamber upper portion, the means for reducing pressure being adapted to suck ink into the chamber upper portion, and said humid environment being maintained in said chamber upper portion.

5. A maintenance station as claimed in claim 4, wherein said means for reducing pressure also removes ink from the chamber upper portion after a predetermined amount ink is accumulated therein.

6. A maintenance station as claimed in claim 5, wherein the seal lips have an outer edge for contacting the printhead face which extend from said base a predetermined distance, the outer edge of the lips defining an opening larger than the seal base opening from which the lips extend, so that a skirt is formed between the outer edge of the lips and the base having a predetermined angle with the seal base.

7. A maintenance station as claimed in claim 6, wherein said means for maintaining a humid environment in the chamber upper portion comprises:

a quantity of fluid in said chamber lower portion, a supply inlet in said chamber lower portion to replenish said fluid, and a passage through said chamber partition with a suitable wicking material therein to wick said fluid from the lower chamber portion into said upper chamber portion for evaporation therein.

8. A maintenance station as claimed in claim 7, wherein the chamber, chamber aperture, and seal means are sized to accommodate a printhead of extended length; and wherein the chamber is pivoted into a sealing relationship with the extended printhead face.

* * * * *